US007048466B2

(12) United States Patent
Benesteau et al.

(10) Patent No.: US 7,048,466 B2
(45) Date of Patent: May 23, 2006

(54) CHANNEL ELEMENT FOR ROAD DRAINAGE GUTTER

(75) Inventors: Claude Benesteau, Cholet (FR); Daniel Pichon, Saint Laurent sur Sevres (FR); Jean-Michel Paucod, Ia Seguiniere (FR)

(73) Assignee: Aliaxis R & D SAS, Vernouillet (FR)

( * ) Notice: Subject to any disclaimer, the term of this patent is extended or adjusted under 35 U.S.C. 154(b) by 0 days.

(21) Appl. No.: 10/493,595

(22) PCT Filed: Oct. 25, 2002

(86) PCT No.: PCT/FR02/03668

§ 371 (c)(1),
(2), (4) Date: Oct. 15, 2004

(87) PCT Pub. No.: WO03/035983

PCT Pub. Date: May 1, 2003

(65) Prior Publication Data

US 2005/0055887 A1 Mar. 17, 2005

(30) Foreign Application Priority Data

Oct. 26, 2001 (FR) ..... 01 13841

(51) Int. Cl.
*E03F 5/06* (2006.01)

(52) U.S. Cl. ..... 404/4; 404/2; 210/164; 405/119

(58) Field of Classification Search ..... 404/2, 404/4; 210/163, 164; 405/119
See application file for complete search history.

(56) References Cited

U.S. PATENT DOCUMENTS

| | | | | | |
|---|---|---|---|---|---|
| 3,225,545 | A | * | 12/1965 | Flegel | 405/43 |
| 4,553,874 | A | * | 11/1985 | Thomann et al. | 404/4 |
| 4,621,939 | A | * | 11/1986 | Thomann et al. | 404/4 |
| 4,640,643 | A | * | 2/1987 | Williams | 404/4 |
| 4,815,888 | A | * | 3/1989 | Stegmeier | 404/4 |
| 5,213,438 | A | * | 5/1993 | Barenwald | 404/2 |
| 5,718,537 | A | * | 2/1998 | Becker et al. | 405/119 |
| 5,803,662 | A | * | 9/1998 | Gunter | 405/119 |
| 5,971,662 | A | * | 10/1999 | Becker et al. | 405/119 |
| 6,027,283 | A | * | 2/2000 | Schweinberg et al. | 405/42 |
| 6,132,137 | A | * | 10/2000 | Gunter | 405/36 |

FOREIGN PATENT DOCUMENTS

| | | |
|---|---|---|
| DE | 88 04 073 | 7/1989 |
| DE | 298 08 197 | 8/1998 |
| EP | 0 748 903 | 12/1996 |

* cited by examiner

*Primary Examiner*—Gary S. Hartmann
(74) *Attorney, Agent, or Firm*—Young & Thompson

(57) ABSTRACT

The invention concerns a channel element (1) for roadway drainage gutter, consisting of a thermoplastic trench body (2) with U-shaped cross-section whereof the horizontal upper ends of the branches (2*a*) are designed to receive a metallic rabbet (3) for receiving and maintaining a metal grate (4) fixed to the channel body (2) with fixing means such as a screw (9)/nut (10), the trench body (2) including at least a bore (6) arranged at the horizontal upper ends of its branches (2*a*) to be aligned with matching orifices (7, 8) provided respectively in the rabbet (3) and in the grid (4) for receiving, preferably with clearance, a screw for fixing (9) the grid. Another bore (11) of smaller diameter than the diameter of the screw (9) is provided beneath said housing.

15 Claims, 5 Drawing Sheets

CHANNEL ELEMENT FOR ROAD DRAINAGE GUTTER

The present invention relates to a channel element for a roadway drainage element constituted by a channel body of thermoplastic material with a U shaped cross-section whose upper horizontal ends of the legs are arranged to receive a metallic rabbet for receiving and holding a metallic grill fixed to the channel body by securement means such as screw/nut. The drainage gutter is made by assembling said drainage elements.

Such drainage elements, which can have a length of 1 m, are constituted by pieces such as a channel body, as well as metallic rabbets and a grill made of steel or cast metal, and of corresponding length.

When a drainage gutter is emplaced on a roadway, it is subject to longitudinal and/or lateral forces exerted by the vehicle wheels while turning or in the course of braking. In particular, the forces exerted can give rise to displacement and/or tearing off of the grills and rabbets relative to the channel body.

Such a channel element is in particular described in EP 0 748 903, in which is proposed a channel with a locking system for the covering grill. To this end, this element comprises an essentially U shaped channel body, a covering grill disposed on the upper edge of the channel body as well as the crosspiece received in its ends in lateral internal walls of the channel body such that it is located within the channel body transversely to the longitudinal axis of this latter. A bore is formed in the sidewalls of the channel to receive a pin which passes through an opening in the grill to be engaged in the bore. The presence of the crosspieces and the securement of the grill by suitable members in bores is not sufficient to eliminate all the risks of tearing loose or of displacement of the grill.

DE-A-298 08197 proposes a channel element of the type constituted by a U shaped body whose sidewalls carry respectively in their upper portion a metallic rabbet. The sidewalls of the U shaped body comprise respectively a longitudinal groove in which is received a longitudinal rib provided on the metallic rabbet. It is thus proposed to immobilize further the metallic rabbet on the channel body. However, this groove has a rounded shape requiring a matching shape of the leg of the rabbet that faces it. Thus, the production of such a channel element is rendered more complicated because the shapes must be in perfect correspondence so that the result, which is to say the immobilization of the rabbet on the body of the channel, will be the maximum possible. Moreover, a phenomenon of lateral sliding of the grill can take place along the groove, which does not promote locking of the grill but on the contrary impedes it.

In DE 88 04 073.9, there is proposed a channel element in which the metallic rabbet comprises an external wing provided with a projection to be received in a groove arranged in the outer surface of a sidewall of the channel body. The rib is of V shape on the external surface of a sidewall of the U shaped channel and the projection is also V shaped so as to match to be received in the groove. Here again, the device is complicated because the wing of the rabbet must have the matching V shape of the V shaped groove and, moreover, longitudinal sliding of the rabbet along the groove is not prevented.

Also, the production of the assembly and these different elements to form the channel element gives rise to a high cost of production and moreover there is not with certainty avoided the drawbacks connected to the presence of forces exerted by vehicles and which can give rise to movement and/or tearing loose of the grills and of the rabbets relative to the channel bodies.

So as to overcome these drawbacks, the invention has for its principal object to propose a channel element whose assembly and locking of the metallic parts such as the rabbet and the grill on the channel body, give to said channel element a high resistance to longitudinal and lateral forces exerted by vehicles on the roadway comprising such channel elements.

Another object is also to provide a channel element whose production, assembly and locking of the rabbet and the grill are economically desirable.

To this end, the invention has for its object a channel element for a roadway drainage gutter, constituted by a channel body of thermoplastic material with a U shaped cross-section whose upper horizontal ends of the legs are arranged to receive a metallic rabbet for receiving and holding a metallic grill fixed to the channel body by securement means such as screw/nut, the channel body having at least one bore provided in the upper horizontal ends of its legs to face matching openings provided respectively in the rabbet and the grill to receive, preferably with play, a securement screw for the grill, characterized in that the channel body has moreover a seat provided in said channel body below said bore to receive a nut which coacts with the screw whilst below said seat is provided another bore of a diameter less than the diameter of the screw so as to create an anti-loosening screw thread brake during assembly on the body of the thermoplastic channel, as well as at each of its upper ends of legs on the vertical internal surface of the latter, a V shaped groove within the body of the channel, provided essentially in its medial region, of at least one projection such as an abutment, a lug or the like.

According to a preferred embodiment of the invention, the channel body has, as a locking means, at least one bore provided at the upper horizontal ends of its legs to face matching openings provided respectively in the rabbet and in the grill to receive a securement screw for the grill, as well as a seat provided in said channel body below each bore to receive a nut which coacts with a screw and below said recess is provided another bore of a diameter less than the diameter of the screw.

The securement screw is thus engaged through the opening of the grill and then that of the rabbet and then coacts with the nut, the end of said screw being engageable in said bore of lesser diameter, when the channel body is hot and relieves the press.

There is thus created an anti-unlocking braking thread of the braked nut type with a plastic ring. Each opening provided in the rabbet and the grill receives the screw with play, this play being suitable to permit the shrinkage taking place during cooling of the channel body. There is thus eliminated any stress that could be exerted at the level of the securement screw, stress engendered by uncontrolled contraction of the thermoplastic channel body relative to the metallic rabbets during cooling.

Preferably, the channel body has at each of its upper ends of the legs, on the internal vertical surface of the latter, a V shaped groove within the channel body, provided essentially in its medial region with at least one projection such as an abutment, a boss or the like.

Because of this, the rabbet thus has at least one cutout in the median portion through which is engageable with play a projection of the V shaped groove of the channel body, when leaving the mold with the channel body hot, the play between the cutout and the projection permitting the symmetrical contraction of the channel body on opposite sides of said projection.

In this way, the central projection locks in translation the rabbet relative to the channel body, which gives rise to good resistance to lateral and longitudinal forces, whilst permitting identical contraction of the channel body on opposite sides of the projection during cooling, and no longer contraction at a single end of the channel body in a random manner.

Thus, the mounting and locking of the metallic portions which are the rabbet and the grill on the hot channel body at the output of the press, are rendered possible by the integration of the post contraction and the plastic material constituting the channel body over all the length of the latter relative to said rigid metallic pieces locked in said channel body.

A channel element according to the invention permits avoiding longitudinal and lateral sliding of the grills during passage of vehicles.

The channel element thus formed has high a resistance to lateral and longitudinal forces as well as good locking and avoidance of unlocking in response to roadway vibrations.

Moreover, the invention has for its object a process for assembling a roadway drainage gutter constituted by a channel body of U shaped cross-section whose upper horizontal ends of the legs are arranged to receive a metallic rabbet for the reception and holding of a metallic grill fixed to the channel body by securement means such as screw/nut, characterized in that there is formed by injection the channel body of a thermoplastic material, having at each of its upper ends of the legs, on an internal vertical surface of the latter, a V shaped groove within the body of the channel and provided essentially in its medial portion with at least one projection, then, when hot at the output of the press, there is emplaced on each horizontal upper end of the legs of the channel body, a metallic rabbet provided with at least one cutout in the medial portion through which a projection of the channel body is engaged with play, then there is installed the grill which is thus fixed with the help of screws which are engaged with play respectively in the openings provided in the grill and in the rabbet and in the corresponding bores provided in the body of the channel, which then coact with nuts disposed in the body of the channel before being engaged in the bores provided in the body of the channel beneath each nut and of a diameter less than the diameter of the screw, thereby permitting creating an anti-unlocking screw thread brake.

Thus, the process according to the invention permits locking the metallic elements of the channel element on the channel body ensuring good resistance of the assembly to lateral and longitudinal forces exerted on a roadway whilst permitting hot assembly at the outlet of the press, economic production with heavy and voluminous pieces.

The invention will be explained in greater detail with reference to the accompanying drawings, in which.

Figure 1:
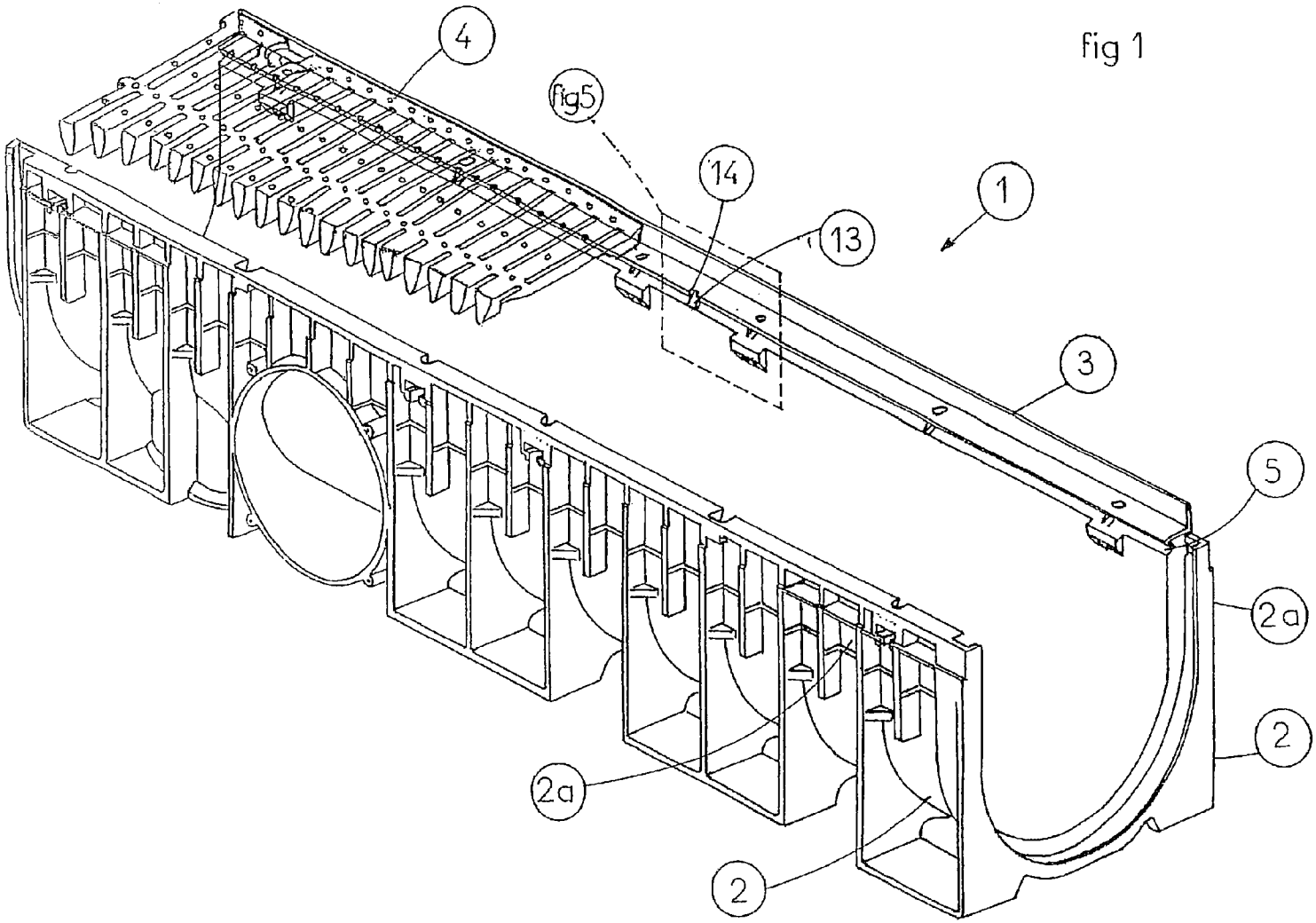
FIG. 1 is a perspective view from above of a channel element according to the invention.
Figure 2:
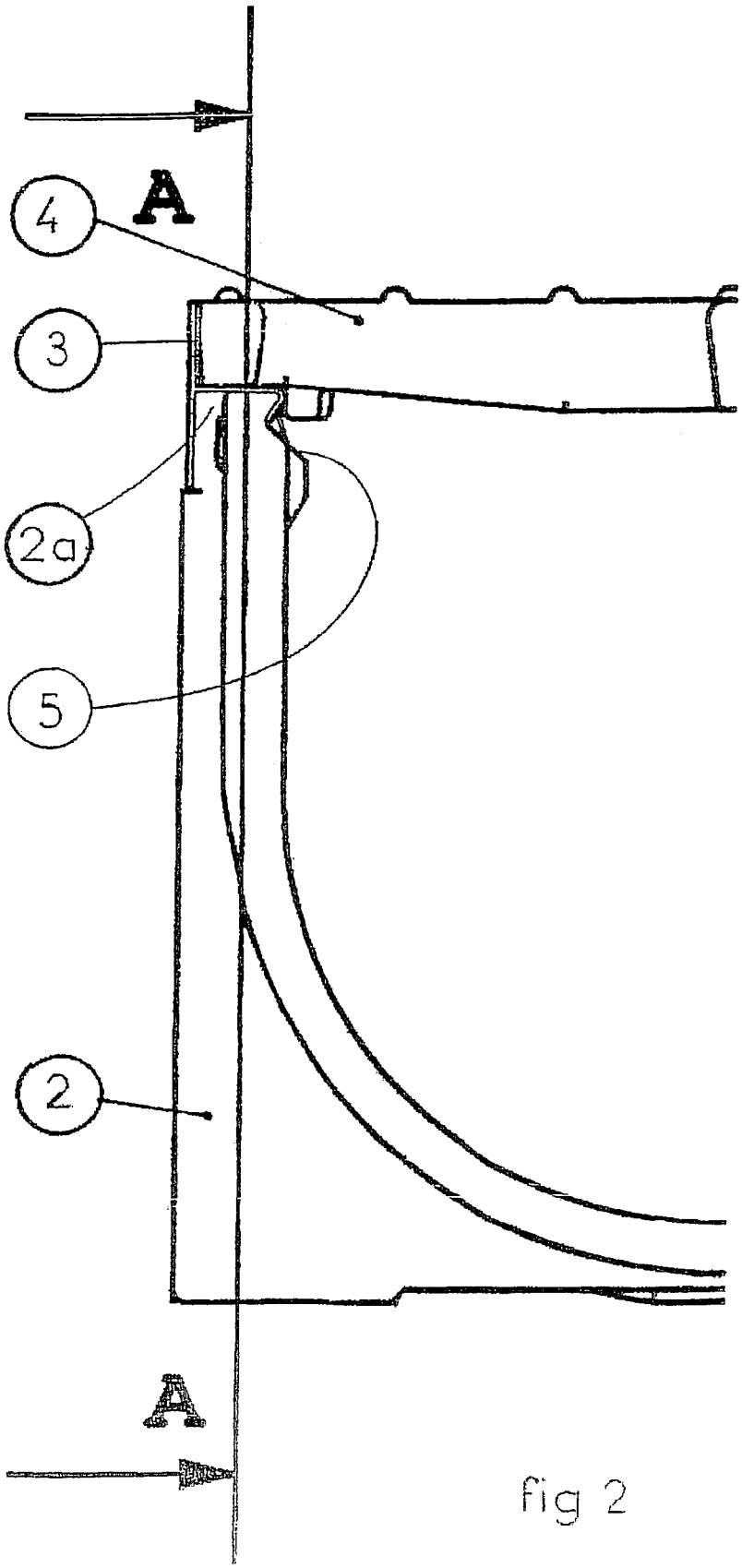
FIG. 2 is a fragmentary view of the male end of a channel element according to the invention.

A channel element 1 according to the invention is constituted by a channel body 2 of thermoplastic material bearing at each of its upper horizontal ends of the legs 2*a* a metallic grill 3 adapted to receive a metallic grill 4.

Each upper end of a leg 2*a* of the channel body 2, on the internal vertical surface of said leg 2*a*, has a V shaped inwardly opening groove 5 on the channel body 2.

The rabbet 3 has an "h" shape obtained, for example by bending a metallic sheet, the small leg 3*a* of the "h" being short and bent inwardly.

Figure 4:
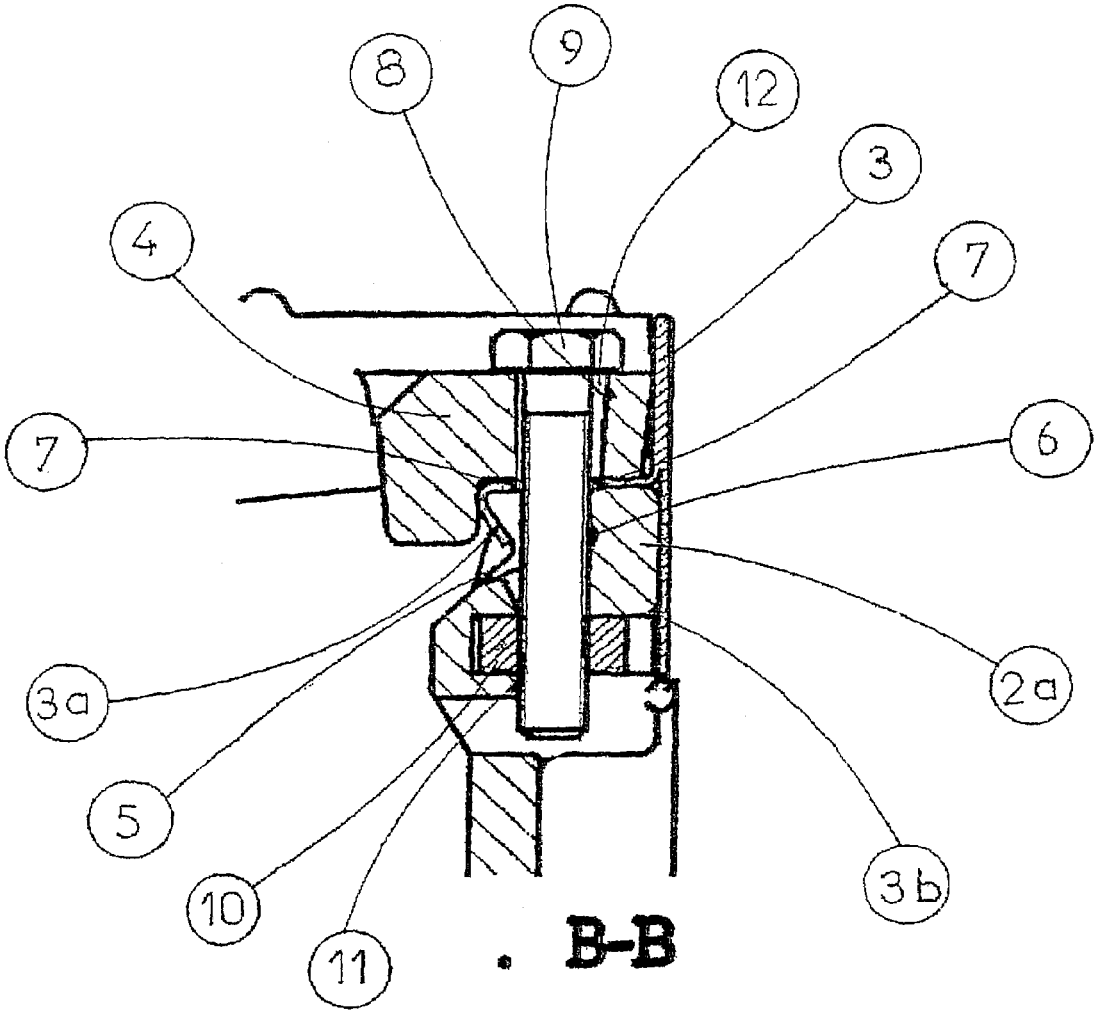
FIG. 4 is a fragmentary cross-section on the line B—B of FIG. 3.
Figure 5:
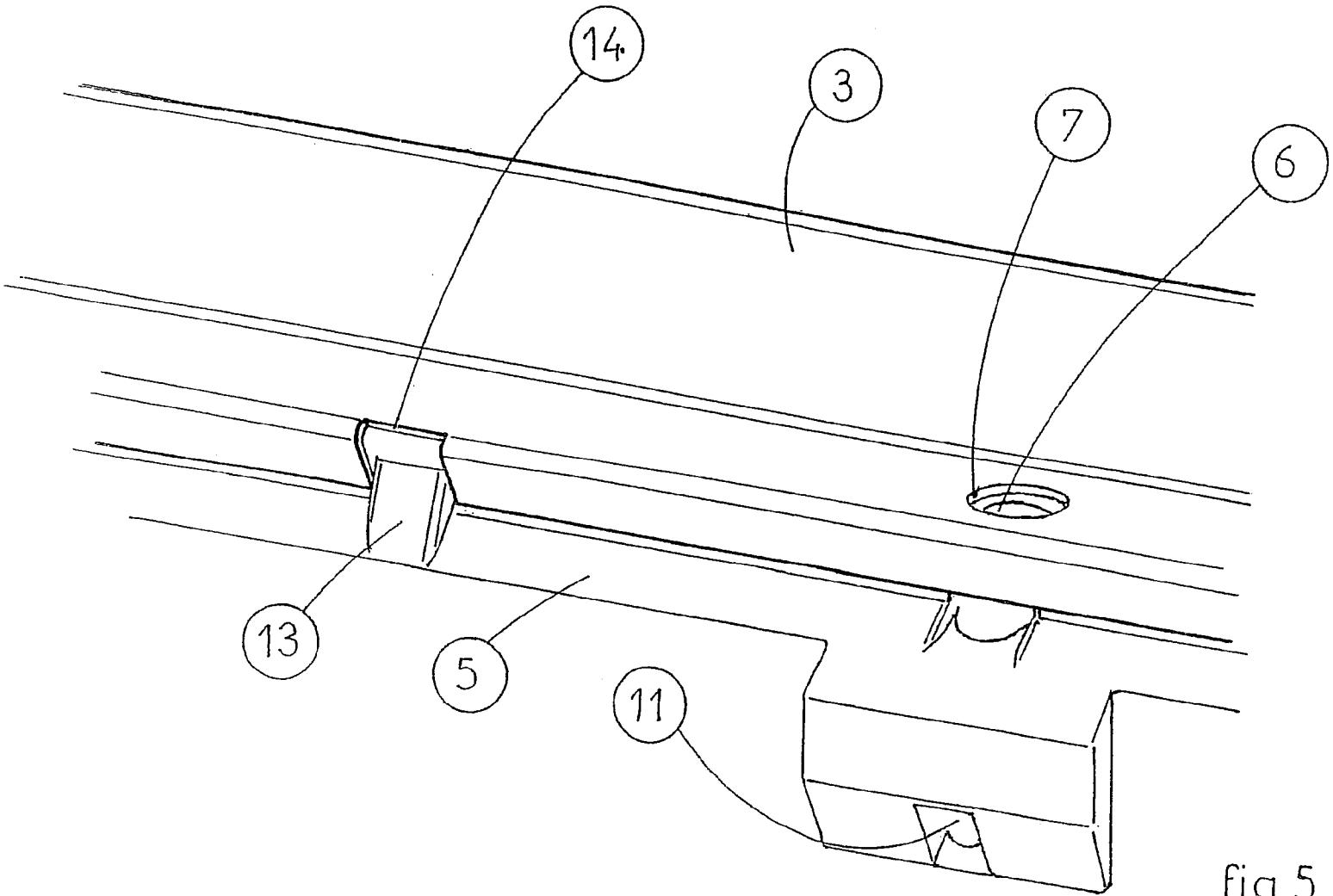
FIG. 5 is an enlarged perspective view of a detail of FIG. 1.

This rabbet 3 is positioned on the upper horizontal end of a leg 2*a* of the channel body 2 so as to grip said upper end, the small bent leg 3*a* of the rabbet 3 being disposed in the V shaped groove 5 as is shown in FIGS. 1 and 4, whilst the other leg 3*b* of the rabbet 3 extends along the external surface of the leg 2*a* of the channel body 2.

The channel body 2 has moreover at the upper horizontal ends of its legs 2*a*, bores 6 positioned to match corresponding openings 7, 8 provided respectively in the rabbet 3 and the grill 4 to receive a securement screw 9 for the grill 4.

A nut 10 is also provided in a seat provided in the body of the channel 2 in prolongation of the bore 6 and which can coact with the screw 9 when the latter is engaged through the opening 8 of the grill 4 and then the opening 7 of the rabbet 3 and then the bore 6 of the channel body.

Below the seat enclosing the nut 10, there is also provided a bore 11 which has a diameter small than the diameter of the screw 9 and in which the end of the screw 9 can be engaged when the channel body 2 is hot, which is to say at the outlet of the press.

The engagement of the screw 9 in the bore 11 permits creating an anti-unlocking screw thread brake.

Figure 3:
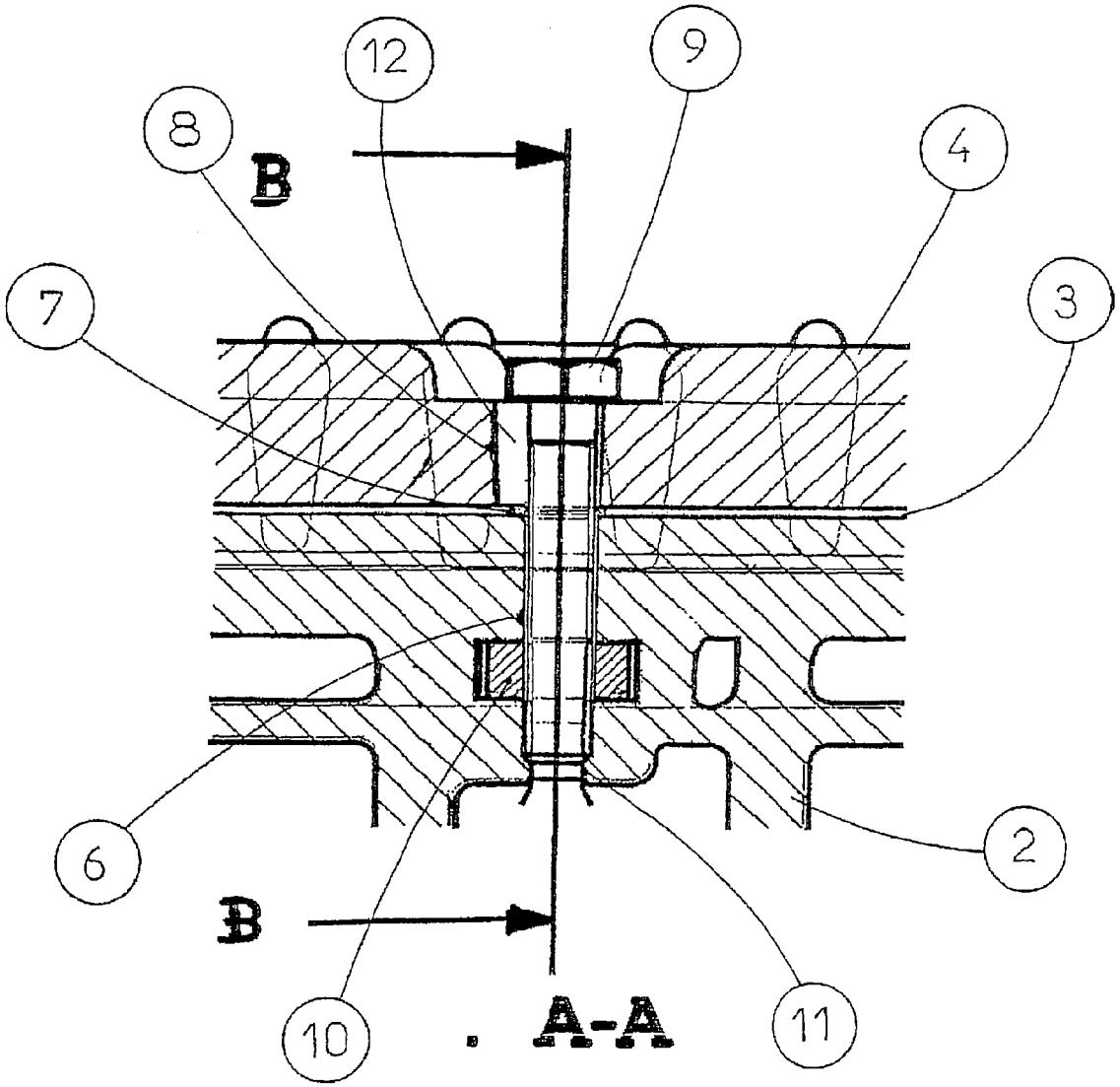
FIG. 3 is a fragmentary cross-sectional view on the line A—A of a channel element of FIG. 2.

Preferably, the openings 7 and 8 receive the screw 9 with play 12 (see in FIGS. 3 and 4), which permits the shrinkage of the thermoplastic material during cooling of the channel body 2.

The V shaped groove 5 provided at the upper vertical ends of the legs 2*a* of the channel body 2 is provided in its medial portion with a projection such as a lug 13.

So as to position the rabbet 3 on the upper end of a leg of the channel body 2, said rabbet 3 has a cutout 14 in its medial portion through which can be engaged with play the lug 13 of the V shaped groove 5 of the channel body 2.

Thus to produce a channel element 1 according to the invention, there is first formed by injection the channel body 1 of thermoplastic material such that the latter has at each of its upper ends of its legs 2*a*, on the internal vertical surface of said legs 2*a*, a V shaped groove 5 provided with a central projection 13.

Then, while hot at the outlet of the press, there is emplaced, on each upper end of each leg 2*a* of the channel body 2, a rabbet 3 provided with a cutout 14 in its medial portion through which the projection 13 of the channel body 2 is engaged with play.

There is then installed the grill 4 which is thus fixed with the help of screw 9 and nut 10. The hot engagement of the screw 9 in the bores 11 provided respectively in the channel body 2 below each nut 10 and of a diameter less than the diameter of a screw 9, thus permits creating an anti-unlocking screw threaded brake.

The play between the cutout 14 and the rabbet 3 and the projection 13 of the channel body 2 permits symmetrical contraction of the channel body 1 on opposite sides of said projection 13 in a manner similar to the play 12 in the openings 7, 8 of the rabbet 3 and the grill 4.

The invention claimed is:

1. Channel element (1) for a roadway drainage gutter, comprising:

a channel body (2) of thermoplastic material of U shaped cross-section, the channel body having legs (2*a*) with upper horizontal ends arranged to receive a metallic rabbet (3) for reception and holding of a metallic grill (4) fixed to the channel body (2) by securement means, the channel body (2) having at least one bore (6) provided at the upper horizontal ends of the legs (2*a*), the bore matching complementary openings (7, 8) provided respectively in the rabbet (3) and in the grill (4), the bore receiving the securement means for the grill (4), a seat provided in said channel body (2) below each bore (6), the seat shaped to receive a nut (10) which coacts with the securement means another bore provided below said seat, the another bore (11) being of a diameter less than a diameter of the securement means and creating an anti-unlocking screw threaded brake during assembly on the channel body, a V shaped groove (5) on an internal surface of the upper ends of the legs (2*a*), the V shaped groove (5) being within the body of the channel (2) and provided essentially in a medial zone of the channel, and the V shaped groove including at least one projection.

2. Channel element (1) according to claim 1, characterized in that the rabbet (3) has an "h" shape.

3. Channel element (1) according to claim 2, characterized in that, the rabbet (3) has at least one cutout (14) in its medial portion, and the projection is engageable, with play, through the cutout.

4. Process for assembly of a channel element (1) according to claim 1, characterized in that sequentially a) the channel body is formed by injection of the thermoplastic material, the channel body having at each of the upper ends of the legs (2*a*), on an internal vertical surface, the V shaped groove (5) within the body of the channel and provided essentially in the medial region with the at least one projection (13), b) while hot at the outlet of a press, the rabbet is emplaced on each horizontal upper end of the legs (2*a*) the metallic rabbet (3) provided with at least one cutout (13) in a medial portion of the rabbet, through which cutout the projection (13) is engaged with the play, and c) the metallic grill (4) is installed, by fixing of screws (9) engaged respectively with play in the openings (8, 7) provided in the grill (4) and in the rabbet (3) and in the bores (6) provided correspondingly in the channel body (2), the screws coacting with nuts (10) seated in the channel body (2) and creating the anti-unlocking screw brake.

5. The channel element of claim 1, wherein, the securement means is one of a screw and a nut.

6. The channel element of claim 1, wherein, the grill receives the securement means (9) with play.

7. The channel element of claim 1, wherein, the securement means is a screw and the grill receives the screw (9) with play.

8. The channel element of claim 1, wherein, the at least one projection is one of a lug and a boss.

9. The channel element of claim 2, wherein, a small leg (3*a*) of the "h" is short and bent inwardly.

10. Channel element assembly for a roadway drainage gutter, comprising:

a metallic rabbet with an opening;

a metallic grill with an opening;

a securement screw;

a thermoplastic channel body with a U shaped cross-section and legs having upper horizontal ends configured to receive the metallic rabbet for reception and holding of the metallic grill fixed to the channel body by the screw;

at least one bore at the upper horizontal ends of the legs, the bore matching the openings of the rabbet and the grill, the bore receiving the screw holding the grill fixed to the channel, a seat in said channel body below the bore;

a nut received in the seat, the nut coacting with the screw;

another bore below said seat, the another bore being of a diameter less than a diameter of the screw and, with the screw, creating an anti-unlocking screw threaded brake on the channel body;

a V shaped groove on an internal surface of the upper ends of the legs, the V shaped groove being within the body of the channel and provided essentially in a medial zone of the channel; and at least one projection on the V shaped groove.

11. Channel element assembly according to claim 10, wherein, the rabbet has an "h"shape.

12. Channel element assembly according to claim 11, wherein, the rabbet has at least one cutout (14) in its medial portion, and the projection is engageable, with play, through the cutout.

13. The channel element assembly of claim 10, wherein, the grill receives the screw with play.

14. The channel element assembly of claim 10, wherein, the at least one projection is one of a lug and a boss.

15. The channel element assembly of claim 12, wherein, a small leg of the "h" is short and bent inwardly.

* * * * *